US008034233B2

(12) United States Patent
Picard et al.

(10) Patent No.: US 8,034,233 B2
(45) Date of Patent: Oct. 11, 2011

(54) PROCESS FOR DESULPHURIZING OLEFINIC GASOLINES TO LIMIT THE MERCAPTANS CONTENT

(75) Inventors: Florent Picard, Communay (FR); Christophe Bouchy, Lyons (FR); Nathalie Marchal, Saint Genis Laval (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 460 days.

(21) Appl. No.: 11/487,605

(22) Filed: Jul. 17, 2006

(65) Prior Publication Data

US 2007/0012596 A1 Jan. 18, 2007

(30) Foreign Application Priority Data

Jul. 18, 2005 (FR) ..... 05 07685

(51) Int. Cl.
*C10G 45/04* (2006.01)
*C10G 45/08* (2006.01)

(52) U.S. Cl. ..... 208/213; 208/209; 208/210; 208/216 R; 208/217

(58) Field of Classification Search ..... 208/112, 208/113, 208 R, 209, 210, 213, 216 R, 217
See application file for complete search history.

(56) References Cited

U.S. PATENT DOCUMENTS

| | | | | |
|---|---|---|---|---|
| 2,746,907 | A * | 5/1956 | Hanson | 208/217 |
| 4,113,603 | A * | 9/1978 | Bauer | 208/89 |
| 5,968,346 | A * | 10/1999 | Jung et al. | 208/210 |
| 5,968,466 | A | 10/1999 | Kharas | |
| 6,126,814 | A | 10/2000 | Lapinski et al. | |
| 6,824,673 | B1 * | 11/2004 | Ellis et al. | 208/58 |
| 2004/0226863 | A1 | 11/2004 | Uzio et al. | |

FOREIGN PATENT DOCUMENTS

| | | |
|---|---|---|
| EP | 0745660 | * 8/1995 |
| EP | 1 369 466 | 12/2003 |

* cited by examiner

*Primary Examiner* — Walter Griffin
*Assistant Examiner* — Renee E Robinson
(74) *Attorney, Agent, or Firm* — Millen, White, Zelano & Branigan, P.C.

(57) ABSTRACT

The invention concerns a process for hydrodesulphurizing a gasoline containing less than 0.1% by weight of sulphur derived from a catalytic cracking unit or other conversion units, said process comprising at least one hydrodesulphurization reactor using a bimetallic catalyst operating at a HSV in the range 0.1 $h^{-1}$ to 20 $h^{-1}$, a temperature in the range 220° C. to 350° C. and a pressure in the range 0.1 MPa to 5 MPa, and comprising recycling a fraction of the desulphurized gasoline to the inlet to the hydrodesulphurization reactor with a recycle ratio in the range 0.1 to 3 times the flow rate of the gasoline to be desulphurized.

19 Claims, 1 Drawing Sheet

PROCESS FOR DESULPHURIZING OLEFINIC GASOLINES TO LIMIT THE MERCAPTANS CONTENT

FIELD OF THE INVENTION

The production of reformulated gasoline satisfying novel environmental specifications necessitates reducing their sulphur content to a much greater extent. Environmental specifications constrain refiners to reducing the sulphur content in the gasoline pool to values of less than or at most equal to 50 ppm in 2005, and it will be reduced to 10 ppm on the first of January 2009 within the European community. Further, desulphurized gasoline must also satisfy specifications as regards corrosive power. The corrosive power of gasoline is essentially due to the presence of acidic sulphur-containing compounds such as mercaptans.

Thus, desulphurized gasoline must contain few mercaptans to limit their corrosivity.

The feed to be treated is generally a gasoline cut containing sulphur, such as a gasoline cut from a coking unit, visbreaking unit, steam cracking unit or catalytic cracking unit (FCC). Said feed is preferably constituted by a gasoline cut derived from a catalytic cracking unit with a distillation range typically in the range 70° C. to about 250° C.

The following discussion will speak generally of catalytically cracked gasoline which are intended to include gasolines comprising a major portion of the gasoline from a catalytic cracking unit, and which may contain fractions of gasoline from other conversion units.

Catalytically cracked gasoline may constitute 30% to 50% by volume of the gasoline pool and generally have high olefin and sulphur levels. However, almost 90% of the sulphur present in reformulated gasolines is attributable to the gasoline from catalytic cracking. The desulphurization of gasoline, principally FCC gasoline, is thus of crucial importance in satisfying current and future specifications.

DISCUSSION OF PRIOR ART

The hydrotreatment or hydrodesulphurizing catalytically cracked gasoline, when carried out under conventional conditions, can reduce the amount of sulphur in the cut. However, such processes have the major disadvantage of causing a very large drop in the octane number of the cut due to hydrogenation of a major portion or even all of the olefins under the normal hydrotreatment conditions.

Processes exist to intensely desulphurize FCC gasoline while keeping the octane number to an acceptable level.

The majority of said processes are based on the principle of selective hydrodesulphurization to transform sulphur-containing compounds into $H_2S$ while limiting the hydrogenation of olefins to paraffins, which transformation induces a large drop in the octane number.

However, the efficacy of said processes is limited by the formation of mercaptans known as recombination mercaptans derived from the addition of the $H_2S$ formed in the reactor with residual olefins. The formation of said recombination mercaptans is described in particular in U.S. Pat. No. 6,231,754 and International patent application WO-A-01/40409, which disclose various combinations of operating conditions and catalysts to limit the formation of recombination mercaptans.

Other solutions to the problem of forming recombination mercaptans are based on a treatment of partially desulphurized gasolines to extract said recombination mercaptans therefrom. Certain of such solutions are described in International patents WO-A-02/28988 or WO-A-01/79391.

The process described in the present invention can significantly reduce the formation of recombination mercaptans and limit the octane number loss during the desulphurization step without resorting to a complementary gasoline treatment step. In fact, the inventors have discovered that it is possible to improve the performance of gasoline-selective desulphurization processes by recycling a fraction of the desulphurized gasoline.

It has been observed that mixing the feed to be treated with a fraction of desulphurized gasoline can significantly reduce the fraction of sulphur-containing compounds present in the form of mercaptans in the desulphurized effluents, while keeping the octane number high.

The use of appropriate recycles to desulphurize gasoline is described in certain publications, but under conditions that differ from the subject matter of the invention and which satisfy different problems.

As an example, U.S. Pat. No. 2,431,920 describes an improvement in gasoline desulphurization, hydrogenation and dehydrogenation reactions by recycling a fraction of the desulphurized effluent to limit the sulphur content of the feed to less than 0.1% by weight.

U.S. Pat. No. 2,431,920 concerns gasoline fractions which contain more than 0.1% by weight of sulphur (i.e. more than 1000 ppm by weight) to desulphurize said fractions and to saturate at least a portion of the olefins.

The present invention differs from the prior art as it is intended to intensely desulphurize gasolines containing less than 0.1% by weight of sulphur while precisely limiting the degree of olefin hydrogenation and the formation of mercaptans.

BRIEF DESCRIPTION OF THE INVENTION

Figure 1:
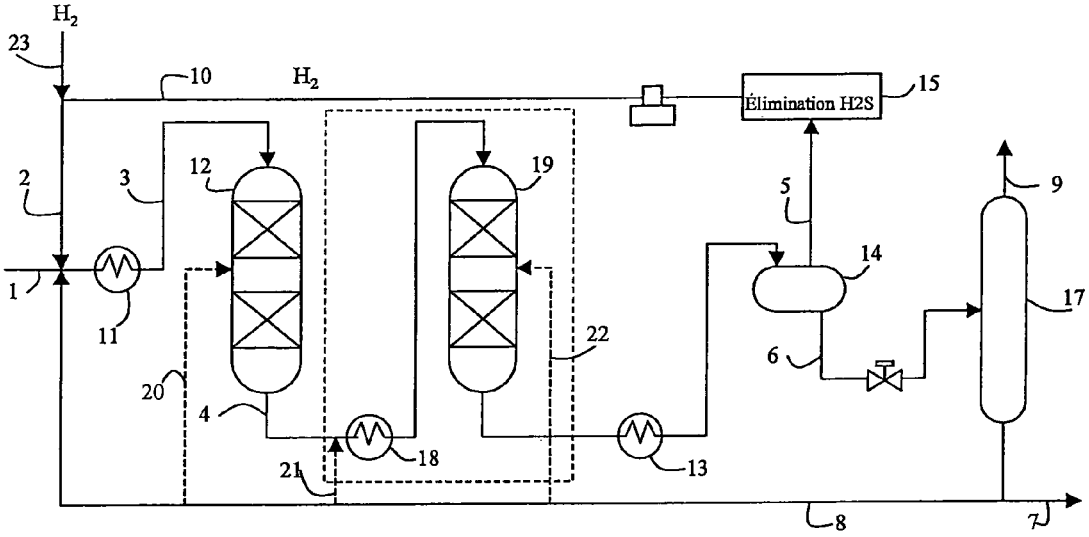
FIG. 1 shows a flowchart for the process of the invention in which the optional elements of the process are shown as dotted lines.

The invention may be described as a process for hydrodesulphurizing a gasoline containing less than 0.1% by weight of sulphur derived from a catalytic cracking unit or a gasoline derived from other conversion units, preferably containing at least a portion of catalytically cracked gasoline, comprising at least one hydrodesulphurization reactor using a bimetallic catalyst operating at a HSV in the range 0.1 $h^{-1}$ to 20 $h^{-1}$, a temperature in the range 220° C. to 350° C. and a pressure in the range 0.1 MPa to 5 MPa (1 MPa=$10^6$ Pascal=10 bars), characterized by recycling a fraction of the desulphurized gasoline to the inlet to the hydrodesulphurization reactor with a recycle ratio in the range 0.1 to 3 times the flow rate of the gasoline to be desulphurized.

The hydrodesulphurization reactor used in the process of the invention is generally a fixed bed reactor, the grain size of the catalyst being of the order of a few millimeters, preferably in the range 1 to 4 mm.

The catalyst used in the process comprises at least one element from group VIII and an element from group VIb, deposited on a porous support, the group VIII element preferably being iron, cobalt or nickel, preferably cobalt and the group VIb element preferably being molybdenum or tungsten, preferably molybdenum.

The hydrodesulphurization catalyst is constituted by a porous support with a specific surface area of less than 200 $m^2$/gram.

The process of the invention may in some cases employ a finishing reactor located downstream of the hydrodesulphurization reactor, said finishing reactor using either a monometallic catalyst or a bimetallic catalyst of the same type as that used in the hydrodesulphurization reactor.

In the case in which the process comprises a finishing reactor, it is particularly advantageous to recycle at least a portion of the desulphurized gasoline to a point located between the hydrodesulphurization reactor and the finishing reactor.

It is also particularly advantageous to recycle at least a portion of the desulphurized gasoline between two catalytic beds of the hydrodesulphurization reactor (or one of the hydrodesulphurization reactors when several function in series or in parallel).

DETAILED DESCRIPTION OF THE INVENTION

The invention concerns a process for desulphurizing gasoline containing less than 0.1% by weight of sulphur in the form of any type of sulphur-containing compound (1000 ppm by weight), preferably less than 950 ppm by weight of sulphur, and more preferably less than 900 ppm of sulphur and highly preferably less than 850 ppm of sulphur, and comprising any type of chemical compound, in particular olefins. The present process is of particular application in the transformation of conversion gasoline, in particular gasoline from catalytic cracking, from fluid catalytic cracking (FCC), from a coking process, from a visbreaking process or from a pyrolysis process.

The process of the invention can produce a gasoline with a very low sulphur content and an improved octane number. The sulphur content of the gasoline obtained using the process of the invention is then generally less than 30 ppm by weight, preferably less than 28 ppm by weight, and highly preferably less than 25 ppm by weight. The mercaptan content of said gasoline is preferably less than 25 ppm by weight, more preferably 22 ppm by weight or less and still more preferably 20 ppm by weight or less.

The process of the invention comprises at least one step for hydrodesulphurizing the gasoline to be treated, optionally followed by a hydrodesulphurization finishing step.

Hydrodesulphurization is carried out in at least one fixed bed reactor which may comprise a plurality of catalytic beds separated by a zone for injecting a cold fluid, termed the chilling zone, to control the temperature rise along the reactor.

The finishing step is also carried out in at least one fixed bed reactor which may comprise a plurality of catalytic beds.

The desulphurized gasoline may be recycled to the inlet to the hydrodesulphurization reactor, or between two consecutive beds of catalyst to the chilling zone, or between the hydrodesulphurization reactor and the finishing reactor.

Regardless of the selected recycle point, the total flow rate of recycled gasoline corresponds to a flow rate in the range 0.1 to 3 times the flow rate of the gasoline to be desulphurized, preferably in the range 0.2 to 2 times the flow rate of the gasoline to be desulphurized, and highly preferably in the range 0.2 to 1 time the flow rate of the gasoline to be desulphurized.

The recycled gasoline is characterized in that it has a sulphur content which is lower than that sulphur content of the gasoline to be desulphurized, preferably a sulphur content which is at least half the sulphur content of the gasoline to be desulphurized.

The operating conditions for the hydrodesulphurization reactor are those used typically to selectively desulphurize olefinic gasolines. As an example, a temperature in the range 220° C. to 350° C. is used, at a pressure which is generally in the range 0.1 to 5 MPa, preferably in the range 1 MPa to 3 MPa.

The hourly space velocity is generally in the range from about 0.1 $h^{-1}$ to 20 $h^{-1}$ (expressed as the volume of liquid gasoline to be desulphurized per volume of catalyst per hour), preferably in the range 0.1 $h^{-1}$ to 10 $h^{-1}$, and more preferably in the range 0.5 $h^{-1}$ to 8 $h^{-1}$.

The ratio of the flow rate of hydrogen to the flow rate of gasoline to be desulphurized is generally in the range 50 liters/liter to 800 liters/liter, preferably in the range 100 liters/liter to 400 liters/liter.

The hydrodesulphurization reactor contains at least one bed of hydrodesulphurization catalyst comprising at least one group VIII element and a group VIb element deposited on a porous support.

The group VIII element is preferably iron, cobalt or nickel.

The group VIb element is preferably molybdenum or tungsten.

The amount of group VIII element, expressed as the oxide, is generally in the range 0.5% by weight to 15% by weight, preferably in the range 0.7% by weight to 10% by weight.

The amount of group VIb metal is generally in the range 1.5% by weight to 60% by weight, preferably in the range 2% by weight to 50% by weight.

The porous support for the hydrodesulphurization catalyst is selected from the group constituted by silica, alumina, silicon carbide or any mixture of said elements in the group.

To minimize olefin hydrogenation, it is advantageous to use a support based on alumina with a specific surface area of less than 200 $m^2$/g, preferably less than 150 $m^2$/g and more preferably less than 100 $m^2$/g.

The porosity of the hydrodesulphurization catalyst is such that the mean pore diameter is generally over 20 nm, preferably in the range 20 to 100 nm (1 nm=1 nanometer=$10^{-9}$ meter).

The surface density of the group VIb metal is preferably in the range $2\times10^{-4}$ to $40\times10^{-4}$ grams of the oxide of said metal per $m^2$ of support, preferably in the range $4\times10^{-4}$ to $16\times10^{-4}$ grams/$m^2$ of support.

Since the group VIb and VIII elements are active in hydrodesulphurization in their sulphurized form, the catalyst generally undergoes a sulphurization step before being brought into contact with the feed to be treated.

In general, said sulphurization is carried out by heat treating the solid by bringing it into contact with a decomposable sulphur-containing compound which generates hydrogen sulphide. The catalyst may also be brought into direct contact with a gas stream comprising hydrogen sulphide.

This sulphurization step may be carried out ex situ or in situ, i.e. inside or outside the hydrodesulphurization reactor.

Optionally, before contact with the feed, the sulphurized catalyst may also undergo a carbon deposition step to deposit a certain amount of carbon, preferably 2.8% by weight or less. Said carbon deposition step is intended to improve the selectivity of the catalyst by preferentially reducing the hydrogenating activity of the catalyst.

Preferably, the amount of carbon deposited is in the range 0.5% to 2.6% by weight. Said carbon deposition may be carried out before, after or during the catalyst sulphurization step.

The process may employ a hydrodesulphurization finishing step using a catalyst comprising at least one element selected from group VIII elements, deposited on a porous support such as alumina or silica.

The amount of group VIII element is in the range 1% to 60% by weight, preferably in the range 2% to 20% by weight. Said group VIII element is introduced in the form of the metal oxide then is sulphurized before use.

This finishing step is principally carried out to decompose saturated sulphur-containing compounds, such as mercaptans or sulphides, contained in the hydrodesulphurization effluent.

When present, this finishing step is carried out at a temperature which is higher than the hydrodesulphurization step.

In a further particular mode of the invention, the finishing step is carried out on a hydrodesulphurization catalyst comprising at least one group VIII element and a group VIb element, deposited on a porous support.

The group VIII element is preferably iron, cobalt or nickel.

The group VIb element is preferably molybdenum or tungsten.

The amount of group VIII element, expressed as the oxide, is in the range 0.5% by weight to 10% by weight, preferably in the range 0.7% by weight to 5% by weight.

The amount of group VIb metal is in the range 1.5% by weight to 50% by weight, preferably in the range 2% by weight to 20% by weight.

The porous support is selected from the group constituted by silica, alumina, silicon carbide or any mixture of said constituent elements.

To minimize olefin hydrogenation, it is advantageous to use a support based on alumina with a specific surface area of less than 200 $m^2/g$, preferably less than 150 $m^2/g$, and more preferably less than 100 $m^2/g$.

The porosity of the catalyst used in the finishing step is such that the mean pore diameter is over 20 nm, preferably in the range 20 nm to 100 nm.

The surface density of the group VIb metal is preferably in the range $2\times10^{-4}$ to $40\times10^{-4}$ grams of the oxide of said metal per $m^2$ of support, preferably in the range $4\times10^{-4}$ to $16\times10^{-4}$ grams/$m^2$ of support.

The catalyst for the finishing step is characterized by a catalytic activity which is generally in the range 1% to 90%, preferably in the range 1% to 70%, and more preferably in the range 1% to 50% of the catalytic activity of the principal hydrodesulphurization catalyst.

The following description of the process will be better understood from the accompanying FIG. 1, which in no way limits the various configurations which the process of the invention may assume.

FIG. 1 shows a hydrodesulphurization reactor divided into two catalytic beds, and a finishing reactor divided into two catalytic beds.

A plurality of hydrodesulphurization reactors functioning in parallel or in series and a plurality of finishing reactors functioning in parallel or in series are entirely possible and encompassed within the scope of the invention.

Similarly, dividing each reactor into more than two catalytic beds is also entirely encompassed within the scope of the invention. The dotted line around the finishing reactor indicates that this finishing step is optional.

DETAILED DESCRIPTION OF DRAWING

The gasoline to be treated is introduced via line (1) then mixed with hydrogen introduced via line (2) and heated in an exchanger train and/or a furnace (11). The hydrogen from line (2) is constituted by a mixture of hydrogen recycled via a line (10) and makeup hydrogen introduced via a line (23).

The mixture heated to the temperature and pressure required to achieve the desired degree of desulphurization is generally in the vapour phase in a line (3).

It is sent to a reactor (12) containing at least one bed of hydrodesulphurization catalyst in a fixed bed.

The effluent from reactor (12) contains hydrocarbons and unreacted sulphur-containing compounds, paraffins from olefin hydrogenation, $H_2S$ from the decomposition of sulphur-containing compounds, and recombination mercaptans from the addition of $H_2S$ to olefins.

The effluent from reactor (12) is sent via a line (4) to an exchange train (13) to condense the hydrocarbon fraction (the portion of FIG. 1 in the rectangle in dotted lines is thus absent from the process flowchart in this variation).

The mixture of liquid hydrocarbons and hydrogen is then separated in a separator drum (14) which allows a liquid fraction to be recovered via a line (6) constituted mainly by desulphurized gasoline, and a gas fraction to be recovered overhead via a line (5) constituted mainly by hydrogen and $H_2S$.

The gaseous effluent is directed via line (5) to a scrubbing section (15) to separate the $H_2S$ and hydrogen.

The pressure in the liquid effluent supplied via line (6) is released and injected into a stripping column (17) to extract the residual $H_2S$ dissolved in the hydrocarbons overhead via a line (9).

The desulphurized gasoline is recovered from the bottom of the stripping column via a line (7). A fraction of this desulphurized gasoline is removed via a line (8) and mixed with the feed introduced via a line (1).

In a further implementation of the process, hydrodesulphurization carried out in the reactor (12) is followed by a hydrodesulphurization finishing step carried out in the finishing reactor (19). In this case, the reaction mixture recovered in line (4) may be reheated in an exchange train or a furnace (18) then sent to the finishing reactor (19) (see the portion of FIG. 1 within the rectangle shown in dotted lines).

A fraction of the desulphurized gasoline may be recycled either via line (1) to the inlet to the hydrodesulphurization reactor, or via a line (20) between two beds of the hydrodesulphurization reactor (12) catalyst, or via a line (22) between two beds of the finishing reactor (19) catalyst, or via a line (21) between the hydrodesulphurization reactor (12) and the finishing reactor (19).

A combination of all of these recycles is also possible and falls within the scope of the invention. The term "combination of recycles" means that a portion of the desulphurized gasoline may be recycled to each of the various recycle points mentioned above. In this case, the recycle may be distributed between the various recycle points in any possible ratio.

EXAMPLE 1

In Accordance with the Prior Art

A continuously functioning hydrodesulphurization reactor was loaded with 100 ml (milliliters) of HR806 catalyst sold by Axens. That catalyst, based on oxides of cobalt and molybdenum, was sulphurized with a mixture of $H_2$ and DMDS under conventional sulphurization conditions to transform at least 80% of metallic molybdenum and cobalt oxides to sulphides.

The characteristics of gasoline A derived from a catalytic cracking unit are summarized in Table 1.

TABLE 1

| Analysis of gasoline A | |
|---|---|
| Sulphur, ppm | 924 ppm by weight |
| Bromine index, mg/100 ml | 50 |
| Simulated initial distillation point | 54° C. |
| Simulated end point | 210° C. |

This gasoline was treated over HR806 catalyst under the following conditions:

Temperature=285° C.

Pressure=2.5 MPa

Feed flow rate=400 ml/h

Hydrogen flow rate=144 l/h

At the outlet from the hydrodesulphurization reactor, the reaction mixture was cooled and the gasoline was separated from the hydrogen in a gas/liquid separator.

The recovered gasoline was stripped with a stream of nitrogen to eliminate residual $H_2S$, then analyzed.

The gasoline produced contained 32 ppm of sulphur, 22 ppm of which was in the form of mercaptans, and had a bromine index of 30 mg/100 ml.

EXAMPLE 2

In Accordance with the Invention

A test was carried out on gasoline A under conditions similar to Example 1.

A fraction of the liquid mixture from the stripper was sent to the feed pot using a pump. The recycle ratio was calculated as the recycle flow rate divided by the flow rate of the fresh feed.

The following test conditions were used:

Pressure=2.5 MPa

Flow rate of feed to be desulphurized=400 ml/h

Hydrogen flow rate=144 l/h

The temperature was adjusted in 1° C. increments to obtain about 30 ppm of sulphur in the mixture.

The recycle flow rate was adjusted to obtain recycle ratios in the range 0.2 to 3. For each recycle ratio, a sample of desulphurized gasoline was recovered and analyzed. Table 2 shows the analyses carried out on the various samples.

| Recycle ratio | 0.2 | 0.5 | 1 | 2 | 3 |
|---|---|---|---|---|---|
| Total flow rate 1/h | 0.48 | 0.6 | 0.8 | 1.2 | 1.6 |
| Temperature, ° C. | 285 | 285 | 286 | 289 | 291 |

Mixture Analysis

| | | | | | |
|---|---|---|---|---|---|
| S, ppm | 29 | 29 | 30 | 29 | 30 |
| RSH, ppm | 20 | 19 | 17 | 13 | 10 |
| IBr mg/100 ml | 30.5 | 31.4 | 31.9 | 31.3 | 30.7 |

Operating the reactor with a recycle of a fraction of the mixture can, for the same amount of sulphur in the mixture, produce a gasoline having a reduced mercaptans content and a higher olefins content.

When the recycle ratio increases, the mercaptans content in the effluent falls, and the olefins content in the effluent, measured by the bromine index (IBr), remains the same, which preserves the octane number.

The entire disclosures of all applications, patents and publications, cited herein and of corresponding French application No. 05/07.685, filed Jul. 18, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for hydrodesulphurizing a gasoline containing less than 0.1% by weight of sulphur derived from a catalytic cracking unit having an inlet and an outlet, or from other conversion units, said process comprising in a hydrodesulfuration reactor conducting at least one hydrodesulphurization reaction of said gasoline in contact with a bimetallic catalyst, operating at an hourly superficial velocity (HSV) in the range of 0.5 $h^{-1}$ to 8 $h^{-1}$, a temperature in the range of 280° C. to 350° C. and a pressure in the range of 1 MPa to 3 MPa, and recycling a first fraction of the desulphurized gasoline from the outlet to the inlet of the hydrodesulphurization reactor with a recycle ratio in the range of 0.2 to 2 times the flow rate of the gasoline to be desulphurized.

2. A hydrodesulphurization process according to claim 1, wherein the hydrodesulphurization reactor functions with a hydrogen/feed volumetric ratio in the range of 50 liters/liter to 800 liters/liter.

3. A process according to claim 2, wherein the hydrogen/feed volumetric ratio is in the range of 100 liters/liter to 400 liters/liter.

4. A hydrodesulphurization process according to claim 1, wherein the catalyst employed comprises at least one element from group VIII and an element from group VIb, deposited on a porous support.

5. A hydrodesulphurization process according to claim 4, wherein the amount of group VIII element, expressed as the oxide, is in the range of 0.5% by weight to 15% by weight, and the amount of group VIb metal is in the range of 1.5% by weight to 60% by weight.

6. A process according to claim 4, wherein the group VIII element is iron, cobalt or mixed and the group VIb element is molybdenum or tungsten.

7. A hydrodesulphurization process according to claim 1, wherein the hydrodesulphurization catalyst comprises a porous support with a specific surface area of less than 200 $m^2$/gram.

8. A hydrodesulphurization process according to claim 1 wherein, prior to contact with the feed, the catalyst undergoes deposition of carbon such that carbon deposited represents an amount of 2.8% by weight or less of said catalyst.

9. A hydrodesulphurization process according to claim 1, further comprising conducting in a finishing reactor a finishing reaction in contact with a bimetallic catalyst of the same type employed in the hydrodesulphurization reactor.

10. A hydrodesulphurization process according to claim 9, wherein the catalyst used in the finishing reactor has an amount of group VIII element, expressed as the oxide, in the range of 0.5% to 10% by weight, and has an amount of group VIb element in the range of 1.5% to 50% by weight.

11. A hydrodesulphurization process according to claim 10, wherein the catalyst used in the finishing reactor has a catalytic activity in the range of 1% to 70%, of the catalytic activity of the catalyst used in the hydrodesulphurization reactor.

12. A hydrodesulphurization process according to claim 10, further comprising recycling a second fraction of the desulphurized gasoline to a point located between the hydrodesulphurization reactor and the finishing reactor.

13. A hydrodesulphurization process according to claim 12, wherein the recycle of a said first fraction of the desulphurized gasoline is made between two catalytic beds located in the same hydrodesulphurization reactor.

14. A process according to claim 13, wherein the group VIII element is iron, cobalt or mixed and the group VIb element is molybdenum or tungsten.

15. A hydrodesulphurization process according to claim 9, further comprising recycling a second fraction of the desulphurized gasoline to a point located between the hydrodesulphurization reactor and the finishing reactor.

16. A hydrodesulphurization process according to claim 15, wherein the recycle of a said first fraction of the desulphurized gasoline is made between two catalytic beds located in the same hydrodesulphurization reactor.

17. A hydrodesulphurization process according to claim 1, further comprising conducting a finishing reaction in a finishing reactor, in contact with a monometallic catalyst containing a group VIII element the amount of which, expressed as the oxide, is in the range of 1% to 60% by weight.

18. A hydrodesulphurization process according to claim 1, wherein the recycle of a said first fraction of the desulphurized gasoline is made between two catalytic beds located in the same hydrodesulphurization reactor.

19. A process according to claim 1, wherein the recycle ratio is in the range of 0.2 to 1 times the flow rate of the gasoline to be desulfurized.

* * * * *